US006328152B1

(12) United States Patent
Focke et al.

(10) Patent No.: US 6,328,152 B1
(45) Date of Patent: Dec. 11, 2001

(54) APPARATUS FOR PRODUCING RECIPROCATING MOVEMENTS

(75) Inventors: Heinz Focke, Verden; Burkard Roesler, Blender, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/418,993

(22) Filed: Oct. 14, 1999

(30) Foreign Application Priority Data

Oct. 15, 1998 (DE) ..... 198 47 433

(51) Int. Cl.[7] ..... B65G 29/00; B65G 37/00
(52) U.S. Cl. ..... 198/468.1; 198/740
(58) Field of Search ..... 198/740, 468.1

(56) References Cited

U.S. PATENT DOCUMENTS

| | | | | |
|---|---|---|---|---|
| 2,221,996 | | 11/1940 | Petskeyes . | |
| 4,744,460 | * | 5/1988 | Pazzaglia | 198/740 |
| 4,805,376 | * | 2/1989 | Oberdorf | 53/151 X |
| 5,060,783 | * | 10/1991 | Chenevard et al. | 198/434 X |
| 5,547,064 | | 8/1996 | Meyer et al. . | |
| 5,842,558 | * | 12/1998 | Spatafora | 198/468.01 |
| 5,894,920 | * | 4/1999 | Chen et al. | 198/740 |

FOREIGN PATENT DOCUMENTS

| | | |
|---|---|---|
| 215 753 | 4/1950 | (AT) . |
| 30 31 367 | 10/1981 | (DE) . |
| 24 62 686 | 8/1985 | (DE) . |
| 35 15 655 | 11/1985 | (DE) . |
| 36 20 101 | 12/1987 | (DE) . |
| 711718 | 5/1996 | (EP) . |
| 937666 | 8/1999 | (EP) . |
| 1028055 | 5/1966 | (GB) . |
| 2079134 | 1/1982 | (GB) . |

* cited by examiner

*Primary Examiner*—Christopher P. Ellis
*Assistant Examiner*—Kenneth W Bower
(74) *Attorney, Agent, or Firm*—Sughrue Mion, PLLC

(57) ABSTRACT

Apparatus or gear mechanism for producing linear movements for pushers, carry-along elements and similar elements, in particular during reciprocating movement. The pushers (24, 25) are connected to a gear mechanism (33), in the case of which use is made exclusively of rotating or circulating elements. Each pusher (24, 25) is connected to a lever (37) which is moved by the gear mechanism such that the connection of the lever (37) to the pusher (24, 25) is moved exclusively on a rectilinear path.

10 Claims, 6 Drawing Sheets

APPARATUS FOR PRODUCING RECIPROCATING MOVEMENTS

BACKGROUND OF THE INVENTION

The invention relates to an apparatus (gear mechanism) for producing essentially rectilinear, in particular reciprocating movements of linear elements, preferably carry-along elements, pushers or the like for pushing articles—a cigarette block—into a pocket of a folding turret.

An important application area of a gear mechanism for producing linear movements is the introduction of the pack contents, namely of a cigarette block, into the pocket of a folding turret or into a partially completed blank for the (cigarette) pack. In the case of a known apparatus (DE 24 62 686), the cigarette block is gripped, on a movement path directed radially in relation to the folding turret, on the rear side by an angled pusher and is pushed into the pocket of the folding turret or into the pack. The pusher can be displaced as a pivotable lever with a sliding piece on a fixed guide rod. The reciprocating drive is executed by a crank.

Such a gear mechanism is problematic for very high cycle speeds on account of the reciprocating movement.

SUMMARY OF THE INVENTION

The object of the invention is to propose an apparatus or a gear mechanism by means of which, even at high cycle speeds, reciprocating linear elements, namely in particular carry-along elements, pushers, etc., move continuously and smoothly to transport articles, in particular to push cigarette blocks into a folding turret, and then to return into the starting position in an—offset—return—movement path.

In order to achieve this object, the apparatus according to the invention is characterized in that the linear element—carry-along element, pusher or the like—can be moved by gear-mechanism elements which execute exclusively rotary movements.

The gear mechanism according to the invention is configured such that the rotary movements of the drive elements are converted into a reciprocating movement of the linear element. The movement sequence as a whole is thus round.

In a preferred embodiment, the gear mechanism comprises a drive element which circulates along an arc of a circle, namely in particular a circulating gear wheel, which rotates about its own axis and is connected to the carry-along element, pusher or the like via a connecting element, in particular via a lever. The lever is fitted on the drive element, namely on the gear wheel, in a fixed position relative thereto and is connected to the carry-along element or a carry-along arm via a rotary bearing.

In the case of a preferred, specific embodiment of the gear mechanism, the drive element runs, as gear wheel, on a fixed toothed rim with an inner toothing arrangement. The lever, which is connected to the gear wheel in a fixed position relative thereto, is connected, via an intermediate gear mechanism or a mating gear mechanism, to the linear element or a carrying arm for the purpose of transmitting the linear movements to the carry-along element or pusher. Parts of the intermediate gear mechanism or mating gear mechanism are controlled in terms of movement such that return movement of the linear element takes place in an offset movement path, in particular above the linear advancement movement. For this purpose, the movement of a pivotable cam lever is controlled via cam rollers in a grooved curve during the rotary movement.

Further details and features of the apparatus according to the invention are explained in more detail hereinbelow with reference to an exemplary embodiment and application example. In the drawings:

DETAILED DESCRIPTION OF THE INVENTION

Figure 1:
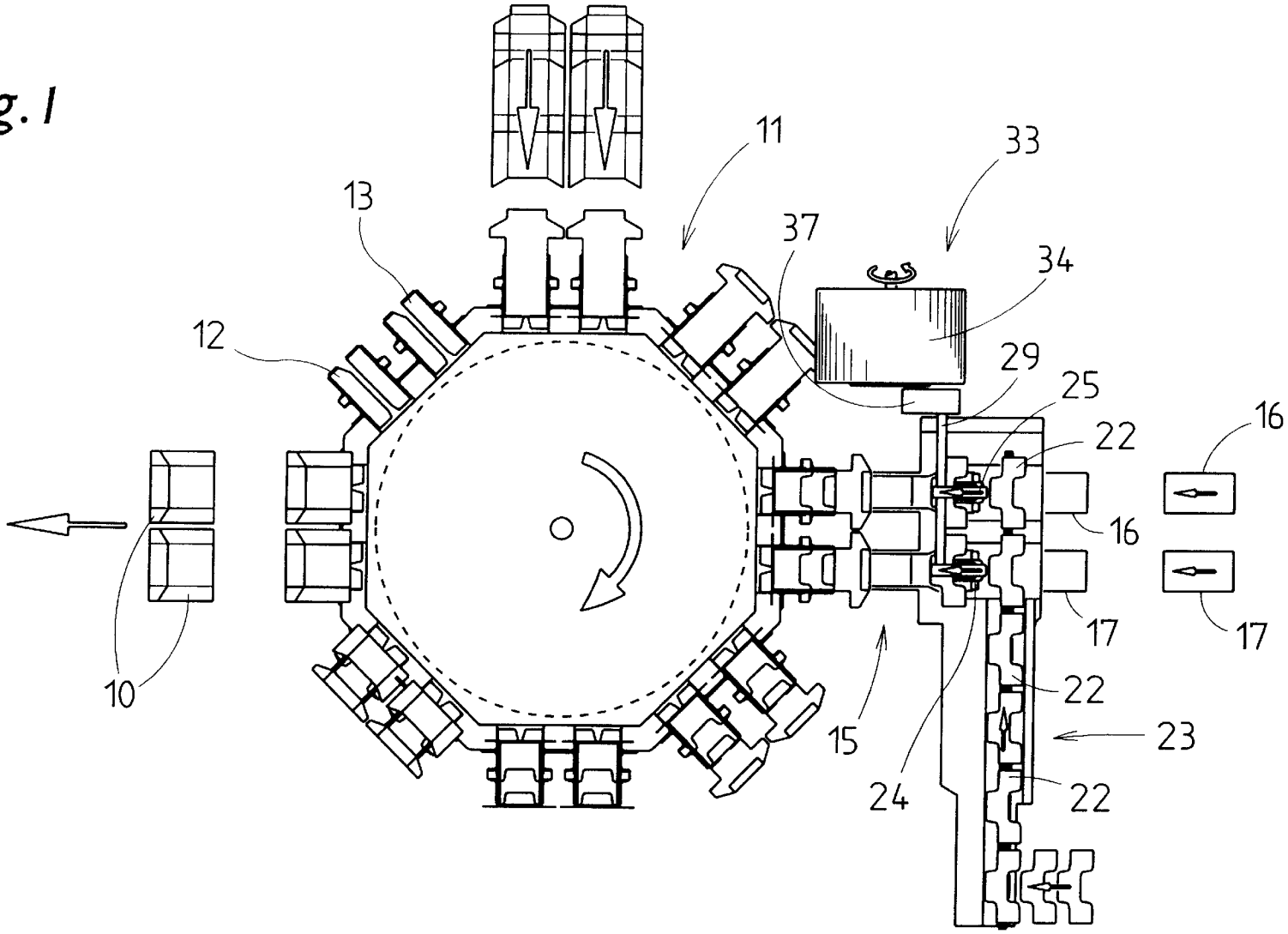
FIG. 1 shows a plan view of a region of a packaging machine with folding turret for producing cigarette packs.
Figure 2:
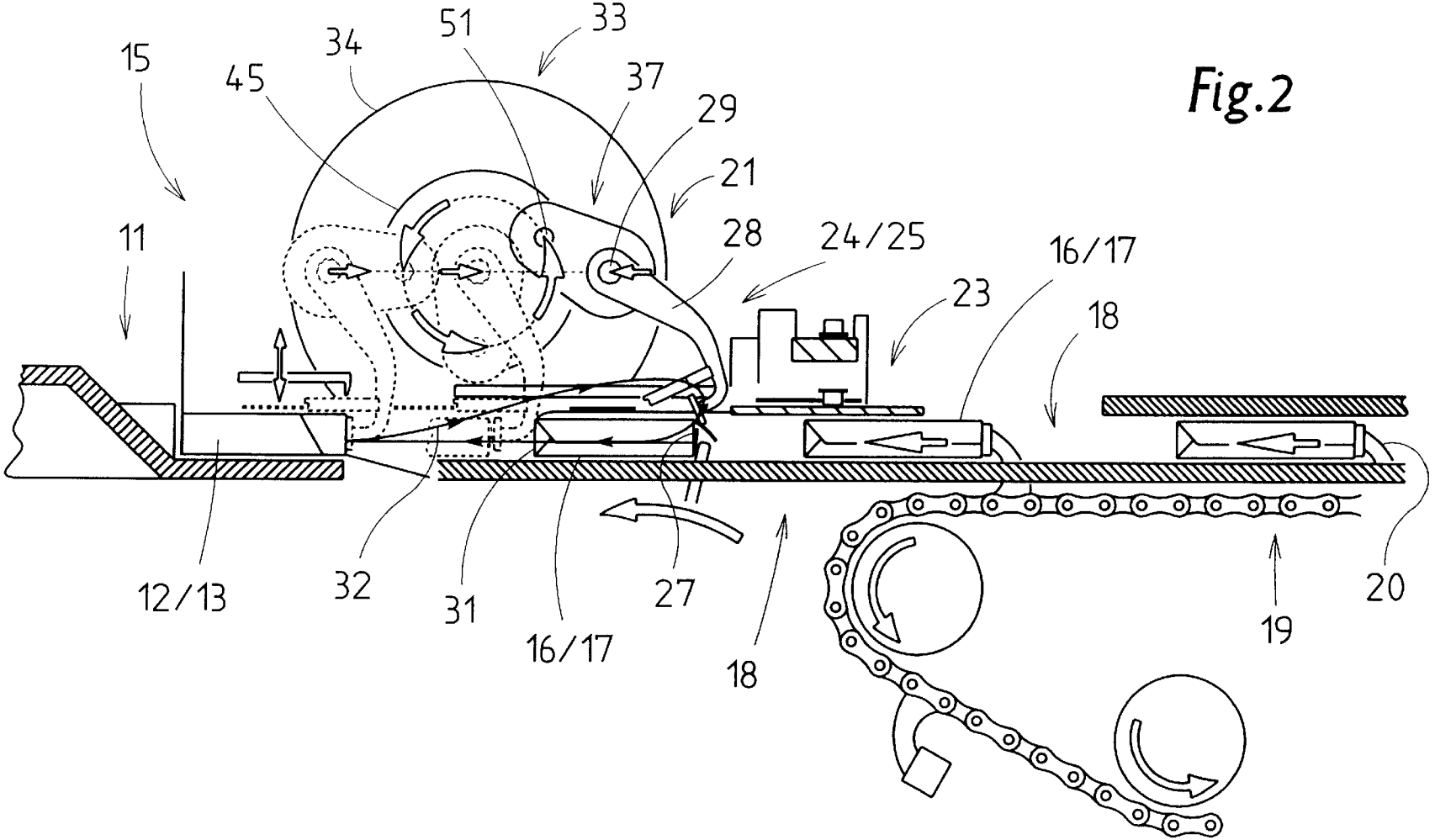
FIG. 2 shows, on an enlarged scale, a region for feeding cigarette blocks to the folding turret in a side view and in vertical section.

The preferred application example which is illustrated in the drawings relates to a packaging machine for producing cigarette packs 10 of the hinge-lid-box type. FIG. 1 shows a schematic plan view of a folding turret 11 which rotates about a vertical axis and has pockets 12, 13 arranged around it in pairs. First of all, blanks 14 for the cigarette packs 10 which are to be produced are introduced into said pockets. Following partial folding of said blanks, the pack contents are pushed radially into the pockets 12, 13, or into the partially folded blanks 10, to be precise in the region of a pushing-in station 15.

The articles which are to be introduced into the pockets 12, 13 are cuboidal cigarette blocks 16, 17. These each comprise a cigarette group, corresponding to the pack contents, which is enclosed by an inner wrapper made of paper or metal-laminated paper.

In the present case, the articles, that is to say cigarette blocks 16, 17, are fed in pairs on a block path 18 on account of the double-path operation of the apparatus. A chain conveyor 19 grips in each case one or two cigarette blocks 16, 17 by way of carry-along elements 20 and conveys the cigarette blocks 16, 17 at a distance apart from one another in the radial direction to the folding turret 11.

The block conveyor, namely chain conveyor 19, terminates at a distance from the folding turret 11. The end phase of the conveying movement and the operation of pushing the articles into the pockets 12, 13 is taken over by a pushing-in unit 21, which grips in each case one cigarette block 16, 17 or two cigarette blocks 16, 17 located one beside the other and conveys the same further on the block path 18 as far as the end position in the pocket 12, 13.

Immediately before the cigarette blocks 16, 17 are taken over by the pushing-in unit 21, separate blanks, namely collars 22, are fed to the cigarette blocks 16, 17. These form a constituent part of a conventional hinge-lid box. The collars 22 are fed on a collar path 23 transversely to the block path 18 and above the same. In each case one collar 22 is deposited in the correct position on a cigarette block 16, 17 and, by virtue of collar side tabs being folded over, is brought into the correct position for the pack. The unit made up of cigarette block 16, 17 and collar 22 is gripped by the pushing-in unit 21 and pushed into the pockets 12, 13. In this respect, the apparatus corresponds, in principle, to that according to DE 24 62 686.

The pushing-in unit 21 is designed in a specific manner. It comprises pushers 24, 25 which are assigned to each block path 18, that is to say to each cigarette block 16, 17, and each have a pusher head 26 which grips the cigarette block 16, 17 on the rear side, namely on an end surface 27, which is directed to the rear as seen in the conveying direction. The two pushers are fitted, by way of a pusher arm 28, on a common actuating element, namely on a transversely directed carrying rod 29.

Figure 3:
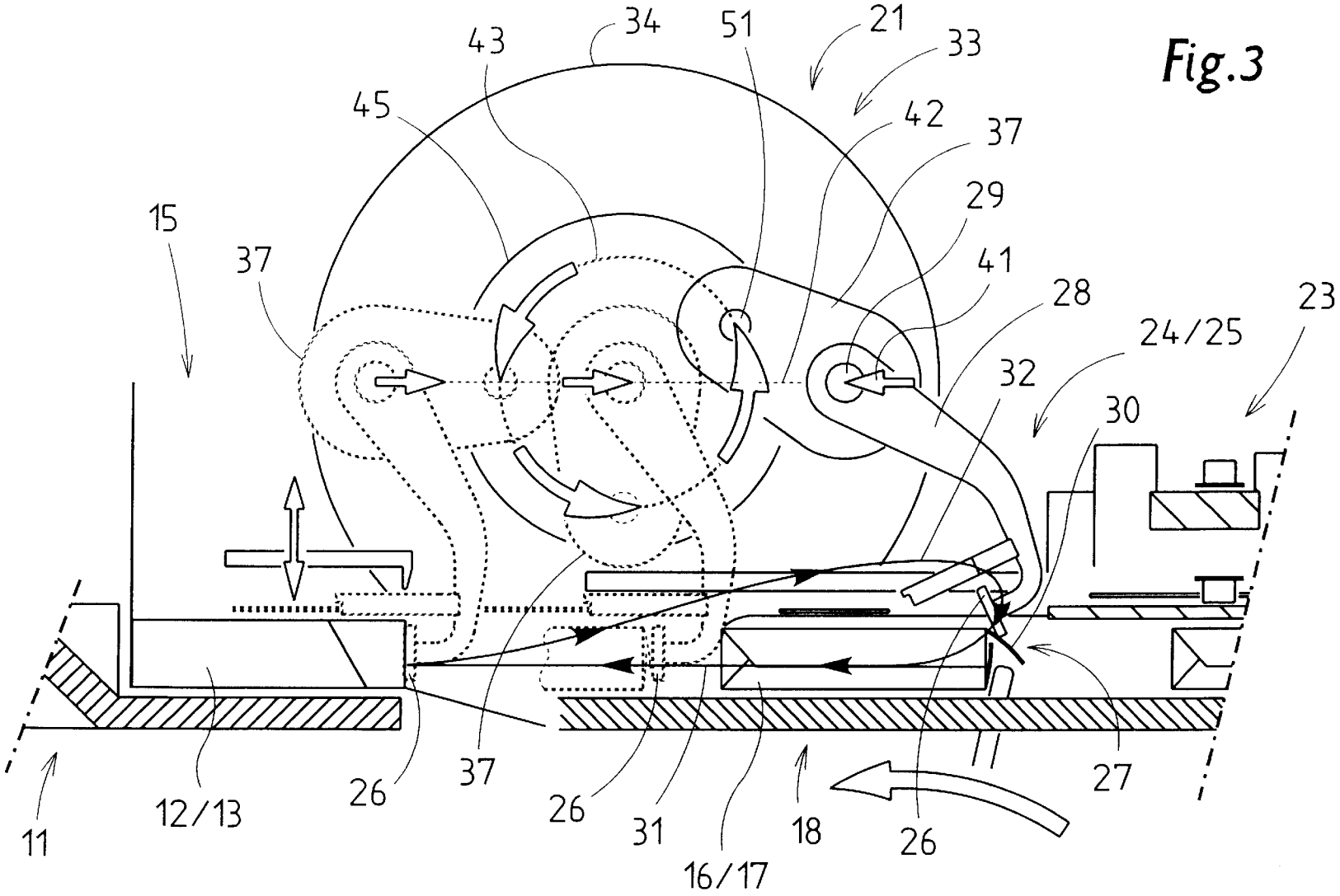
FIG. 3 shows, on a further-enlarged scale, a detail of FIG. 2 in a corresponding illustration.
Figure 4:
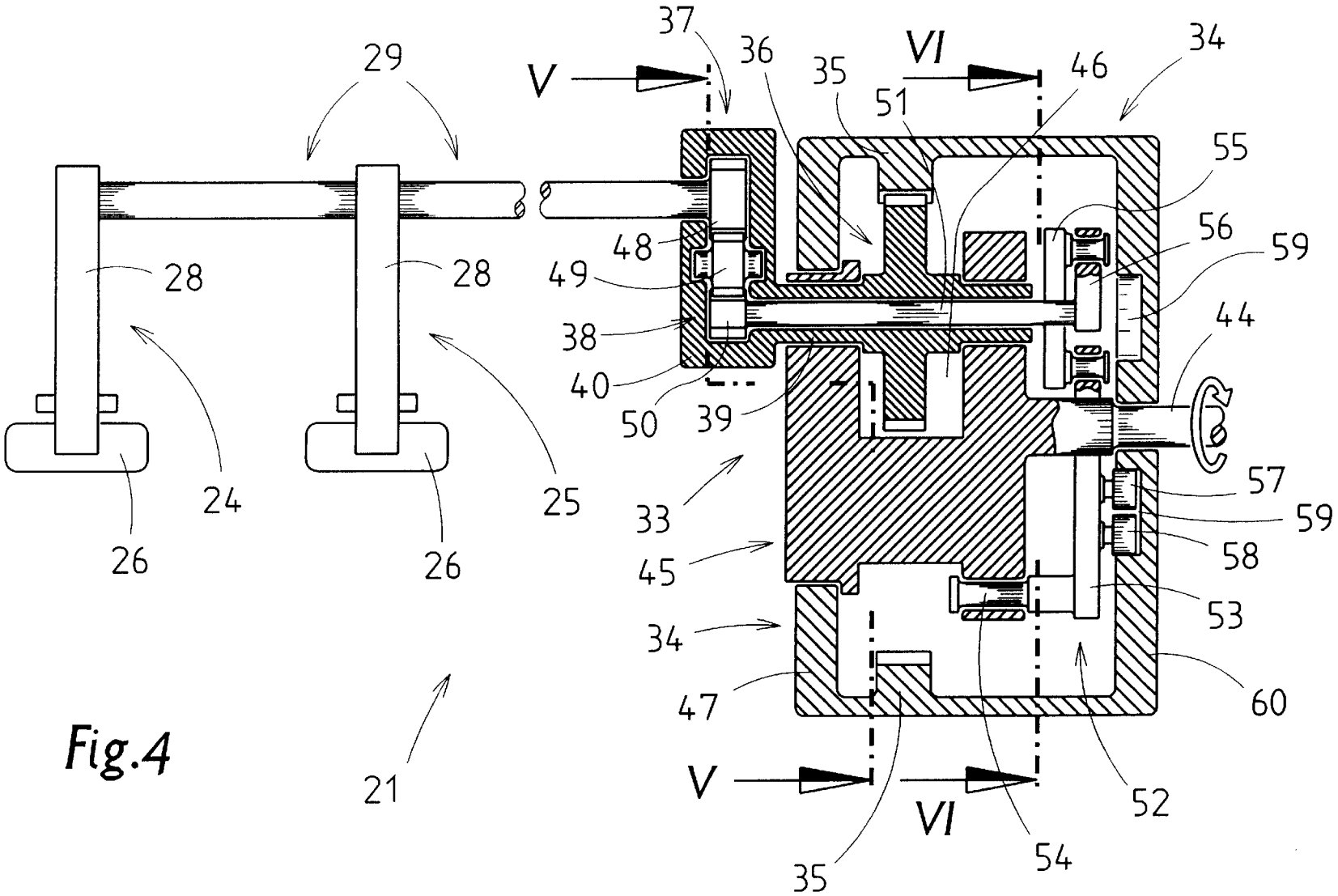
FIG. 4 shows an axial section of the gear mechanism for moving carry-along elements or pushers.
Figure 5:
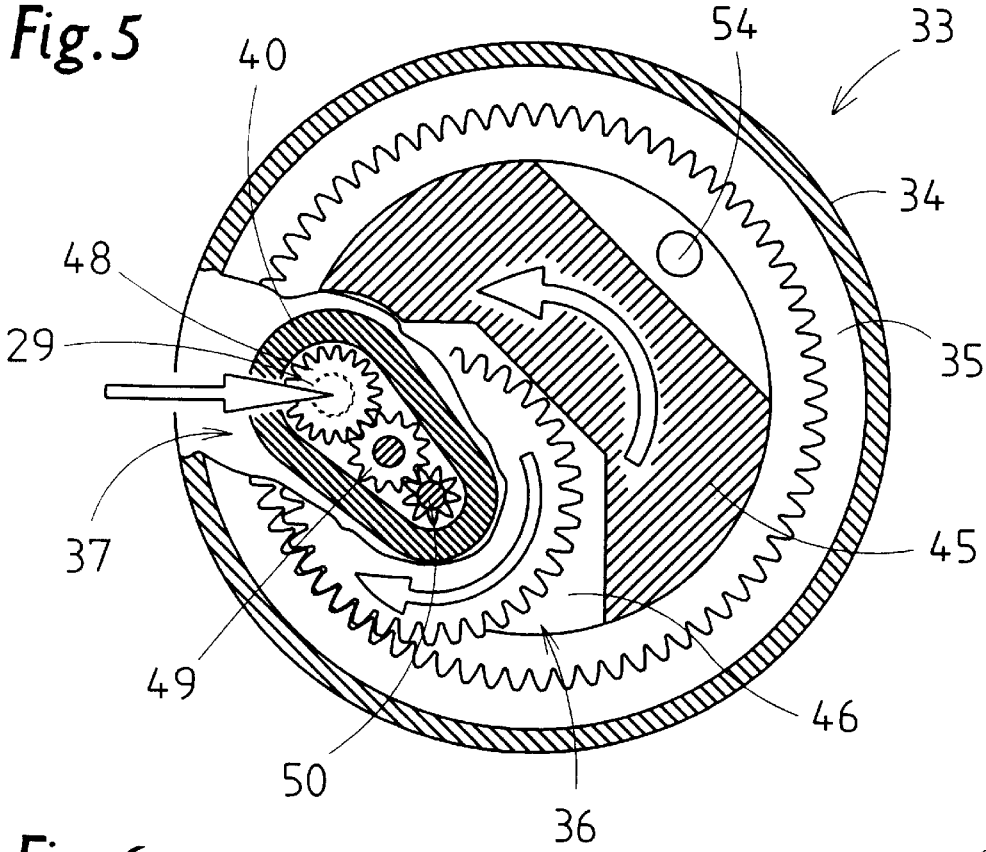
FIG. 5 shows a cross section through the gear mechanism in the section plane V—V from FIG. 4.
Figure 6:
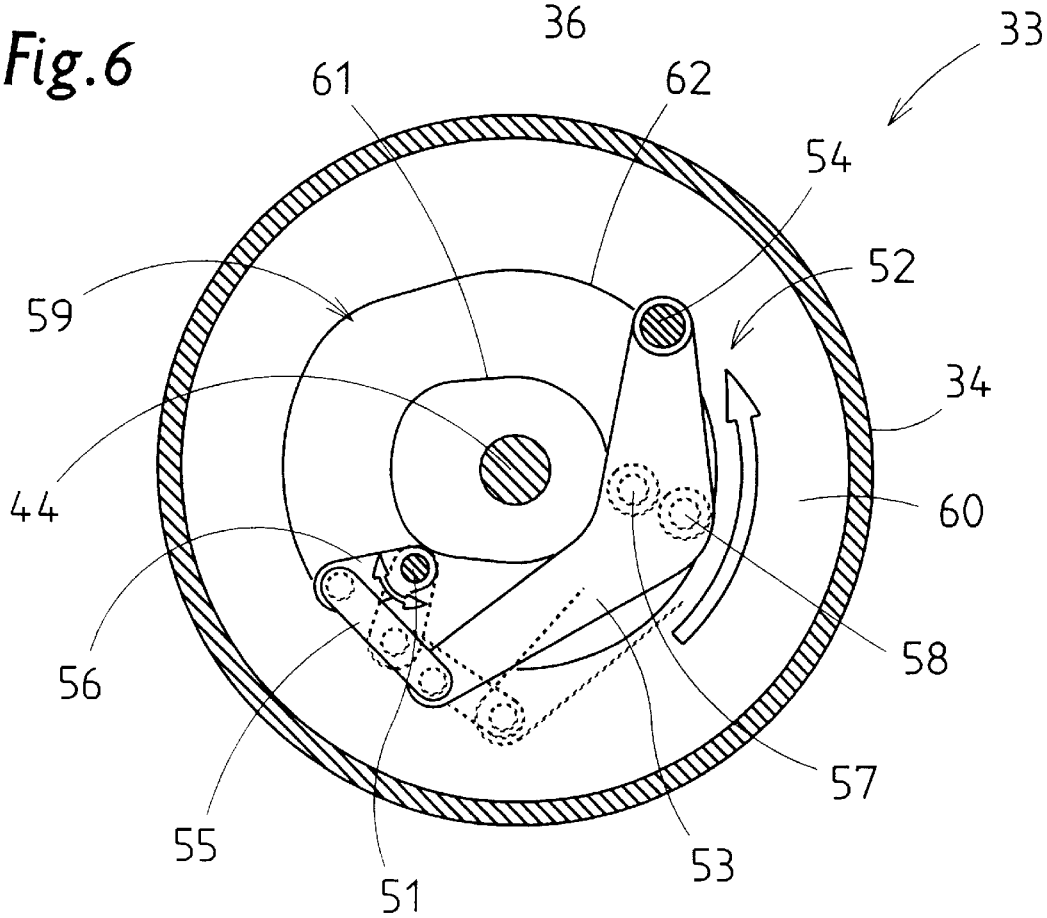
FIG. 6 shows a cross section through the gear mechanism according to FIG. 4 in the section plane VI—VI.

The pushers 24, 25 are moved such that the pusher heads 26 enter from above into the movement path of the articles, namely the cigarette blocks 16, 17 (on the right in FIG. 3). The pusher head 26 is moved in this case such that a folding tab 30, which is first of all directed to the rear, is folded over against the rear side of the cigarette block 16, 17, that is to say against the end surface 27. The pusher head 26 then moves the cigarette block 16, 17 along a rectilinear movement path 31, to be precise as far as the end position within the folding turret 11. Thereafter the pushers 24, 25 return into the starting position, in which case the pusher head 26 is moved along an arcuate return path 32. This runs upwards, in the direction counter to the movement path 31, to a position above the following cigarette blocks 16. The pusher head 26 then returns, in an arcuate turning loop, into the carry-along position, that is to say into the movement path 31.

The pushers 24, 25 are actuated, for the purpose of executing the movements, via a specific gear mechanism 33. The latter comprises elements which execute exclusively circular or rotating movements.

A fixed running path for a circulating gear-mechanism element is located in a housing 34. The running path is designed as a toothed rim 35 with an inner toothing arrangement. A gear wheel, namely a central wheel 36, runs on the toothed rim 35 or on the toothing arrangement thereof. Said central wheel transmits the drive to the pushers 24, 25, namely to the carrying rod 29.

For this purpose, a connecting element, namely a lever 37, is connected to the central wheel in a fixed position relative thereto. The lever 37 is designed in this case as a hollow body and accommodates a differential gear mechanism 38.

The lever 37 is located outside the housing 34 and has one end region connected to the central wheel 36 in a fixed manner, that is to say in a non-changeable position relative thereto. In the present case, the central wheel 36 forms a hollow shaft 39 which passes laterally out of the housing 34 and is connected to the lever 37 and/or to an outer lever housing 40. The carrying rod 29 is connected in a rotatable manner to the lever 37 at a distance from the hollow shaft 39.

The central wheel 36 is driven such that it rotates on the toothed rim 35 of its own accord. This achieves specific kinematics: the connection of the carrying rod 29 to the lever 37, that is to say the axial centre of the carrying rod 29, executes exclusively a linear movement, namely a movement along a straight line, corresponding to the movement path 31 of the pusher head 26. The other important point of the lever 37, namely the axial centre of the hollow shaft 39, runs in the process on an arc of a circle, concentrically with the toothed rim 35. It is important to have a geometrical relationship such that the distance (centre-to-centre distance) between the carrying rod 29 and hollow shaft 39 corresponds to half the radius of the outer movement path of the central wheel 36, said outer movement path being defined by the toothed rim 35. FIG. 3 in particular illustrates, with reference to the arrows 41, that the relevant fixed point of the lever 37, in the present case the carrying rod 26, runs on a straight line 42. The other fixed point, namely the centre of the hollow shaft 39, runs on a concentric circle arc 43. The drive is transmitted to the gear mechanism via a central shaft 44. The central shaft 44 enters into the housing 34 and is connected to a drive body 45 within said housing. Said drive body is provided with a cutout 46 in which the central wheel 36 is mounted in a rotatable manner, offset in relation to the central shaft 44, namely via the hollow shaft 39. The drive body 45 is mounted in a rotatable manner in a housing wall 47. The movements of the central wheel 36 are transmitted to the carrying rod 29 not directly by the lever 37, but rather via the differential gear mechanism 38 within the lever 37. The differential gear mechanism 38 comprises three interacting gear wheels, namely a first gear wheel 48 at the end of the carrying rod 29, a rotatably mounted intermediate wheel 49 and a further gear wheel 50 on a transmission rod 51 mounted within the hollow shaft 39. On the one hand, the differential gear mechanism 38 formed in this way has the task of reversing the movement direction for the carrying rod 29, with the result that the carrying rod 29 is not rotated with the lever 37 about its own axis. Furthermore, the differential gear mechanism 38 provides a transmission ratio, resulting in the movement being transmitted in the ratio 1:2. The pushers 24, 25 execute two movement cycles during a full revolution of the central wheel 36.

The specific return movement of the pushers 24, 25 along the return path 32 is brought about by an additional gear mechanism 52 which is arranged within the housing 34. The additional gear mechanism 52 has a steering lever 53. The latter is connected to the drive body 45 via a rotary bearing 54. The rotary bearing 54 is located in a region diametrically opposite the hollow shaft 39. The other end of the steering lever 53 is connected in an articulated manner to a connecting rod 55 which, in turn, is connected to the end of the transmission rod 51 via a connecting lever 56. The connecting lever 56 is connected in a non-rotatable manner to the transmission rod 51, but in an articulated manner to the connecting rod 55. The movement path (return path 32) described is made possible in that the steering lever 53 is guided by way of contact rollers 57, 58 which enter into a curved groove 59. The latter is arranged in a stationary manner, to be precise in a rear wall 60 of the housing 34. Two mutually parallel contact rollers 57, 58 run, without making contact with one another, in the curved groove 59, that is to say one runs on an inner curved path 61 and the other runs on an outer curved path 62.

The central shaft 44, as drive element for the pushers 24, 25, is driven in time with the machine.

Figure 7:
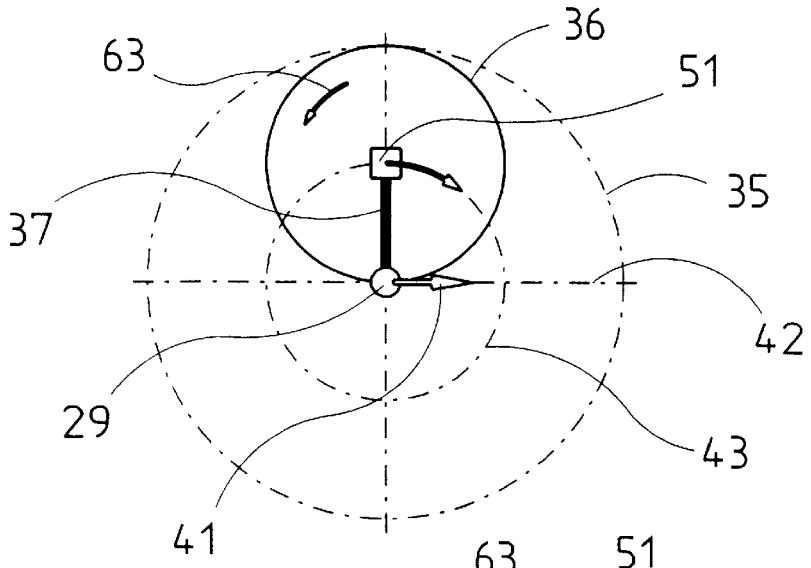
FIG. 7 to FIG. 9 show a schematic representation of parts of the gear mechanism with their movement paths in various positions.
Figure 8:
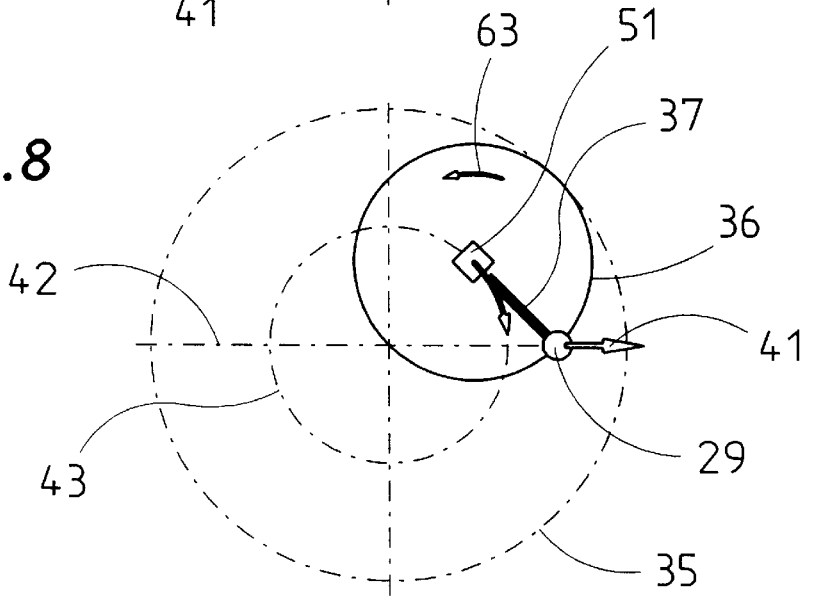
Figure 9:
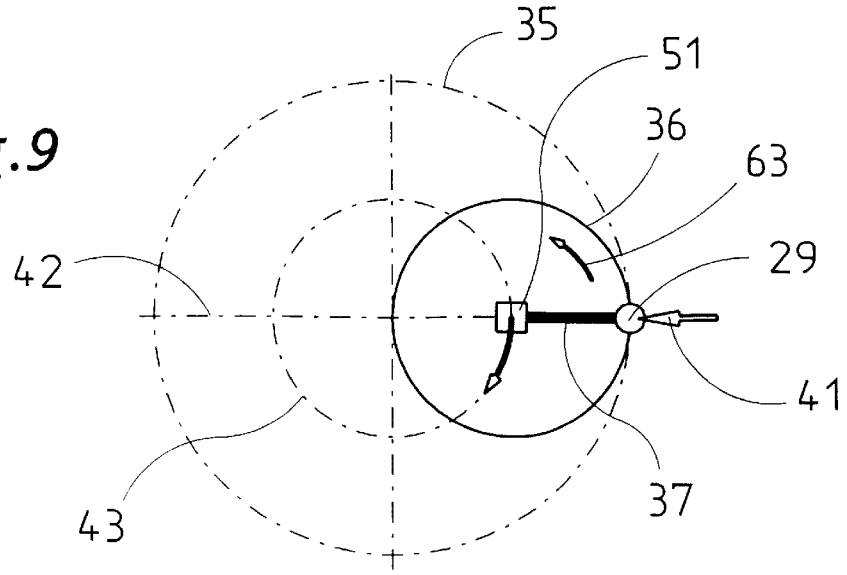

FIG. 7, FIG. 8 and FIG. 9 show in schematic representation various positions of important elements of the gear mechanism. The movement paths are represented here as broken lines. As can be seen, the central wheel 36, represented by the solid-line circle, executes a clockwise rotational movement along the (inner) toothed rim 35. In the process, the central wheel 36 rotates counterclockwise, as shown by arrow 63, around its own axis. The latter, in turn, is schematically represented by the transmission rod 51 as a square. From this the lever 37, which revolves on a circle arc 43, leads in the radial direction to the central wheel 36 at its outer perimeter, i.e. to a connection point for the pusher or pusher arm 28, which can be moved back and forth exclusively on the straight line 42. This point is defined by the carrying rod 29. The movement phases of the toothed rim 35 are shown in FIGS. 7 to 9. The central wheel 36 runs completely around, with the corresponding positions of the described members being thus formed.

What is claimed:

1. An apparatus for producing essentially rectilinear movements of a linear element for pushing articles into a pocket (12, 13) of a folding turret (11), characterized in that the linear element (24, 25) is moved by elements of a circulating gear-mechanism (34, 35 and 36) which comprises a central wheel (36) which rotates within the gear mechanism and circulates along a circular path.

2. The apparatus according to claim 1, characterized in that the linear element comprises a pusher (24, 25) which is connected in a rotatable manner to a lever (37), wherein a region of the connection between the lever (37) and the pusher (24, 25) travels exclusively along a rectilinear movement path (42).

3. The apparatus according to claim 2, characterized in that pusher (24, 25) is connected to a transversely directed carrying rod (29) which is connected to the lever (37) and/or to a differential gear mechanism (38).

4. The apparatus according to claim 2, characterized in that the lever (37) is connected in a fixed non-changeable position relative to a drive element.

5. The apparatus according to claim 4, characterized in that the central wheel (36) runs on inner teeth of a toothed rim (35) of the gear mechanism (33), and is driven via a central shaft (44).

6. The apparatus according to claim 5, characterized in that the central wheel (36) is driven by a drive body (45) which is connected to the central shaft (44), the central wheel (36) being mounted in a rotatable manner, offset in relation to the central shaft (44), in a region of a U-shaped cutout of the drive body (45).

7. The apparatus according to claim 5, characterized in that movements of the central wheel (36) or of the lever (37) connected thereto are transmitted to the pusher (24, 25) via a differential gear mechanism (38).

8. The apparatus according to claim 7, characterized in that the differential(gear) mechanism (38) is mounted within the lever (37), which has a hollow body, so that a first gear wheel (48) is connected to pusher (24, 25), and a second gear (50) is connected to the central wheel (36) or a transmission rod (51), and in that arranged between the first and second gear wheels (48 and 50) is an intermediate wheel (49) which is mounted in a rotatable manner in the hollow body of the lever (37).

9. The apparatus according to claim 3, characterized by an additional gear mechanism (52) for producing a return path (32) which deviates from said rectilinear movement path (31) of the pusher (24, 25).

10. The apparatus according to claim 9, characterized in that the additional gear mechanism (52) acts, via the differential gear mechanism (38), on the carrying rod (29) via a transmission rod (51) which runs concentrically with the central wheel (36) and is connected to a gear wheel (50) of the differential gear mechanism (38), and to the additional gear mechanism (52).

* * * * *